United States Patent [19]

Snyder

[11] Patent Number: 4,494,799

[45] Date of Patent: Jan. 22, 1985

[54] TUNNEL BORING MACHINE

[75] Inventor: Larry L. Snyder, Golden, Colo.

[73] Assignee: Harrison Western Corporation, Lakewood, Colo.

[21] Appl. No.: 466,033

[22] Filed: Feb. 17, 1983

[51] Int. Cl.[3] ..... E21C 25/16; E21D 9/08

[52] U.S. Cl. ..... 299/31; 299/33; 299/56; 299/58; 175/61; 175/76; 405/146; 405/141

[58] Field of Search ..... 299/11, 31, 33, 56, 299/57, 58, 90; 175/94, 61, 76; 405/146, 141

[56] References Cited

U.S. PATENT DOCUMENTS

| | | | |
|---|---|---|---|
| 3,061,288 | 10/1962 | Robbins | 299/31 |
| 3,309,142 | 3/1967 | Winbers | 299/56 |
| 3,672,726 | 6/1972 | House | 299/11 |
| 3,963,080 | 6/1976 | Walker | 175/94 |
| 4,140,345 | 2/1979 | Babendererde et al. | 299/11 |
| 4,193,637 | 3/1980 | Spencer | 299/56 |
| 4,311,344 | 1/1982 | Akesaka | 299/33 |
| 4,420,188 | 12/1983 | Robbins et al. | 299/31 |

FOREIGN PATENT DOCUMENTS

| | | | |
|---|---|---|---|
| 1534611 | 3/1968 | Fed. Rep. of Germany . | |
| 1590016 | 7/1981 | United Kingdom | 299/31 |

*Primary Examiner*—Stephen J. Novosad
*Assistant Examiner*—Mark J. DelSignore
*Attorney, Agent, or Firm*—Klaas & Law

[57] ABSTRACT

A tunnel boring machine for boring a tunnel through mixed ground with stable ground conditions and unstable ground conditions. The tunnel boring machine is operable in a stable ground boring mode with the machine anchored to tunnel sidewall portions and also in an unstable ground mode wherein cutting thrust is provided by a shield means in cooperation with tunnel lining structure. Combined mode operation is also possible. The machine comprises a rotatable cutting wheel means positioned at the front end of the machine which may be selectively thrustingly engaged with the tunnel end face for cutting away material away to elongate the tunnel; rotation means operably associated with the rotatable cutter wheel means for selectively causing rotation thereof at various speeds of operation; extendable and retractable central thrust rod means for transmitting forward thrust to the cutting wheel means; central body means for supporting the central thrust rod means in extendable and retractable relationship therein; central thrust generating means operably associated with the central body means for extending and retracting the central thrust rod means; extendable and retractable sidewall engaging means mounted on the central body means for selectively grippingly engaging opposite portions of the tunnel peripheral sidewall; central body support means for supporting the central body means on the floor of the tunnel; annular shield means operably mounted on the central thrust rod means for shielding a forward portion of the machine; extendable and retractable shield thrust means operably associated with the shield means for coacting with the tunnel lining structure to produce forward thrust on the cutting wheel means; muck removal means for removing material cut away from the tunnel face by the cutting wheel means and control means for selectively operating various machine components.

39 Claims, 9 Drawing Figures

TUNNEL BORING MACHINE

The present invention relates generally to tunnel boring machines and more specifically to a hard rock tunnel boring machine capable of high performance boring in geological formations having both stable ground portions and unstable ground portions.

Tunnel boring machines have long been used in mining for cutting tunnels through various earthen strata. Boring machines generally have a rotating cutting wheel positioned at the front end of the machine which is thrust against the tunnel end face by various thrusting apparatus. The cutting wheel removes rock by spalling the tunnel end face. The rock cuttings are removed from the end face area by various muck conveying systems. Tunnel boring machines have been used most effectively in areas having stable ground conditions wherein the ground is essentially self supporting while being cut by the boring machine. The bare tunnel side walls are often gripped by such machines for forward thrusting support and steering. State of the art hard rock tunnel boring machines have demonstrated average rates of tunnel advance on the order of 35 meters per day in "good ground", i.e. stable ground.

When boring through "bad", i.e. unstable ground, boring machines generally referred to as "shield machines", have been used in place of hard rock tunnel boring machines. The shield machines operate in cooperation with a tunnel lining structure which is erected in previously bored portions of the tunnel. The tunnel lining structure is used by a shield machine as a basis of support for forward thrusting. The tunnel lining structure and a cylindrical shield, which is generally positioned in annular relationship about a forward portion of a shield machine, prevent the tunnel portion being bored from collapsing on the machine or jamming the cutter wheel. However, shield machines are generally operable at much slower rates than conventional tunnel boring machines due to the fact that a tunnel lining must be constructed to provide a shield machine with a thrusting platform.

Problems in the use of ground boring machines often arises when fault zones or other unstable ground boring conditions are interspersed in small areas throughout otherwise stable ground. A typical machine tunnel length may contain only 5% of such unstable ground conditions however, it is not uncommon that these limited bad ground zones will account for 25% or more of the tunnel boring machines operating time. The delays associated with boring such bad ground zones often make conventional tunnel boring machines an uneconomical means of excavation.

There are a number of problems which hard rock tunnel boring machines encounter in such "mixed" ground conditions. The cutter wheel may become jammed with loose material, requiring that the cutting wheel be stopped and the machine backed up if possible to remove the loose material from the tunnel face and unjam the wheel. The roof of the tunnel may collapse on the machine in bad ground conditions before the tunnel lining can be erected. The machine may over excavate the tunnel diameter due to loose material in the cutting wheel area. The machine may lose its gripping and/or steering ability because of over-excavation or because it is unable to grip soft tunnel walls. The machine may be incapable of controlling high inflows of water or loose earth material. The machine may break down mechanically as a result of being operated beyond its normal limits in an attempt to excavate through the "bad" ground zone.

It would be generally desirable to provide a tunnel boring machine having the capability of cutting through stable ground at normal tunnel boring machines operating rates and having a capability of cutting through bad ground with the efficiency of a shield machine. Present boring machines have not been able to meet these goals because of the substantially different performance characteristics and designs of conventional hard rock tunnel boring machines and shield machines.

OBJECTS OF THE INVENTION

It is among the objects of the invention to provide a tunnel boring machine which may be used as a hard rock tunnel boring machine and as a soft ground shield machine for boring tunnels in mixed ground conditions.

It is another object of the invention to provide a tunnel boring machine which is efficient and cost effective to operate in mixed ground boring conditions.

It is another object of the invention to provide a tunnel boring machine having a stable ground mode of operation, an unstable ground mode of operation, and a combined mode of operation.

It is another object of the invention to provide a tunnel boring machine which may be used to bore horizontal tunnels, downwardly inclined tunnels, upwardly inclined tunnels, or upwardly extending vertical shafts.

It is another object of the invention to provide a tunnel boring machine which may be operated with manual controls.

It is another object of the invention to provide a tunnel boring machine which may be equipped with computer operated controls.

SUMMARY OF THE INVENTION

The tunnel boring machine of the present invention is a machine having a capability of excavating a tunnel at high advanced rates in good ground and efficient slower advance rates in bad ground. The machine has two basic operating modes. It can operate as a hard rock machine, thrusting the cutting wheel forward by gripping the bare tunnel sidewall, in a stable ground mode of operation or it can operate as a soft ground shield machine, thrusting the cutting wheel forward by pushing on the excavation lining. In an unstable ground mode of operation, it may also operate in a combined mode, thrusting the cutting wheel forward by pushing on both the excavation lining and the tunnel sidewall.

The forward portion of the machine is supported by the shield which is positioned in annular relationship about a forward portion of the machine just rearward of the cutting wheel cutting surface. The rear portion of the machine is comprised with a support means such as support wheels which may be extended or retracted to change the elevation of the rear end of the machine for proper vertical centering and also for "prying" the machine loose in the event the cutter wheel or shield become jammed. The support wheels also allow the rear end portion of the machine to be moved forward after a cutting stroke in stable ground mode operation. Use of clamp legs in cooperation with a central thrust cylinder is described in my pending U.S. patent application Ser. No. 461,683 filed Jan. 27, 1983 which is hereby incorporated by reference for all that it teaches.

When operating as a hard rock machine in good ground, the machine is anchored to the rock wall by laterally extending wall engaging means such as clamp legs. A central longitudinal thrust cylinder means attached to the clamp legs provides the forward thrust to the machine during the cutting stroke in stable ground mode operation.

When operating as a soft ground shield machine in fractured unstable rock and rubble, the machine is thrust forward by peripheral shield cylinders pushing axially against the tunnel lining structure. The stable ground mode thrust system may be combined with the unstable ground thrust system to add additional thrust by gripping the tunnel lining structure with the lateral clamp legs. The clamp legs may also be used to assist in steering, machine stabilization, and in properly centering a rear portion of the machine within the tunnel.

The tunnel boring machine of the present invention is operable in good rock conditions at an RPM which is as fast as practical in order to maximize the rate of performance with the available horsepower and which is operable in poor rock conditions at a slower RPM than in good rock conditions in order to obtain higher torque and to reverse impact loads.

The cutter wheel of the machine may be operated in reversible directions of rotation in order to help unjam the cutterwheel in poor rock conditions. The cutterwheel may be operated in good rock conditions at the torque which is required to turn the wheel with a full compliment of cutter devices operating at maximum penetration. The machine may be operated in poor rock conditions at a torque which is higher than that used in good rock conditions in order to overcome additional loads of rock lying against "false faces" and to resist stalling.

In good rock conditions the machine is operable with the amount of thrust required to obtain the maximum allowable design load per cutter device. In poor rock conditions the machine is operable with a higher thrust than in good rock conditions in order to hold loose material in the face in order that it can be crushed rather than merely ripped out.

The cutterwheel of the device is designed to have strength requirements efficient to withstand the increased thrust and torque and overturning movements caused by uneven rock loads encountered in poor rock conditions. The cutterwheel is capable of providing full support at a rock face and is solid to restrict the intrusion of large blocks and/or to limit the flow of loose material. The cutterwheel is also designed to provide access to the cutterwheel face to allow change of the cutter devices.

The machine is operable in good rock conditions in a stable ground mode with tunnel ground support provided approximately one machine diameter from the tunnel face. In poor rock conditions, the machine is operable in an unstable ground mode with ground support provided immediately behind the gage cutters.

The machine, when operated in good rock conditions, has a cutting stroke which is as long as practical for minimum resetting operations. In poor rock conditions, the machine cuts the tunnel end face in a continuous operation with resetting operations being provided simultaneously with the cutting so that the machine is not stopped, thus reducing the possibility of the cutterwheel becoming stuck.

The machine is provided with clamp legs which are used to engage the tunnel sidewall in high pressure compressive relationship in good ground conditions to provide a thrust and torque reaction system to prevent rearward movement of the machine during a cutting stroke. The machine also has a shield thrusting system which is used in poor rock conditions in cooperation with the tunnel lining structure and provides a thrust and torque reaction system which is operable without transmitting reaction force to the tunnel walls.

The machine may be operated without grouting in good rock conditions and may be operated in conjunction with grouting of the tunnel face to stabilize the face and restrict water inflow in poor rock conditions. The machine may be operated without a tunnel lining structure in good rock conditions and may be operated in cooperation with a tunnel lining structure which may be installed while the machine is operating in poor rock conditions.

BRIEF DESCRIPTION OF THE DRAWINGS

An illustrative and presently preferred embodiment of the invention is shown in the accompanying drawing in which.

DETAILED DESCRIPTION OF THE INVENTION

Figure 1:
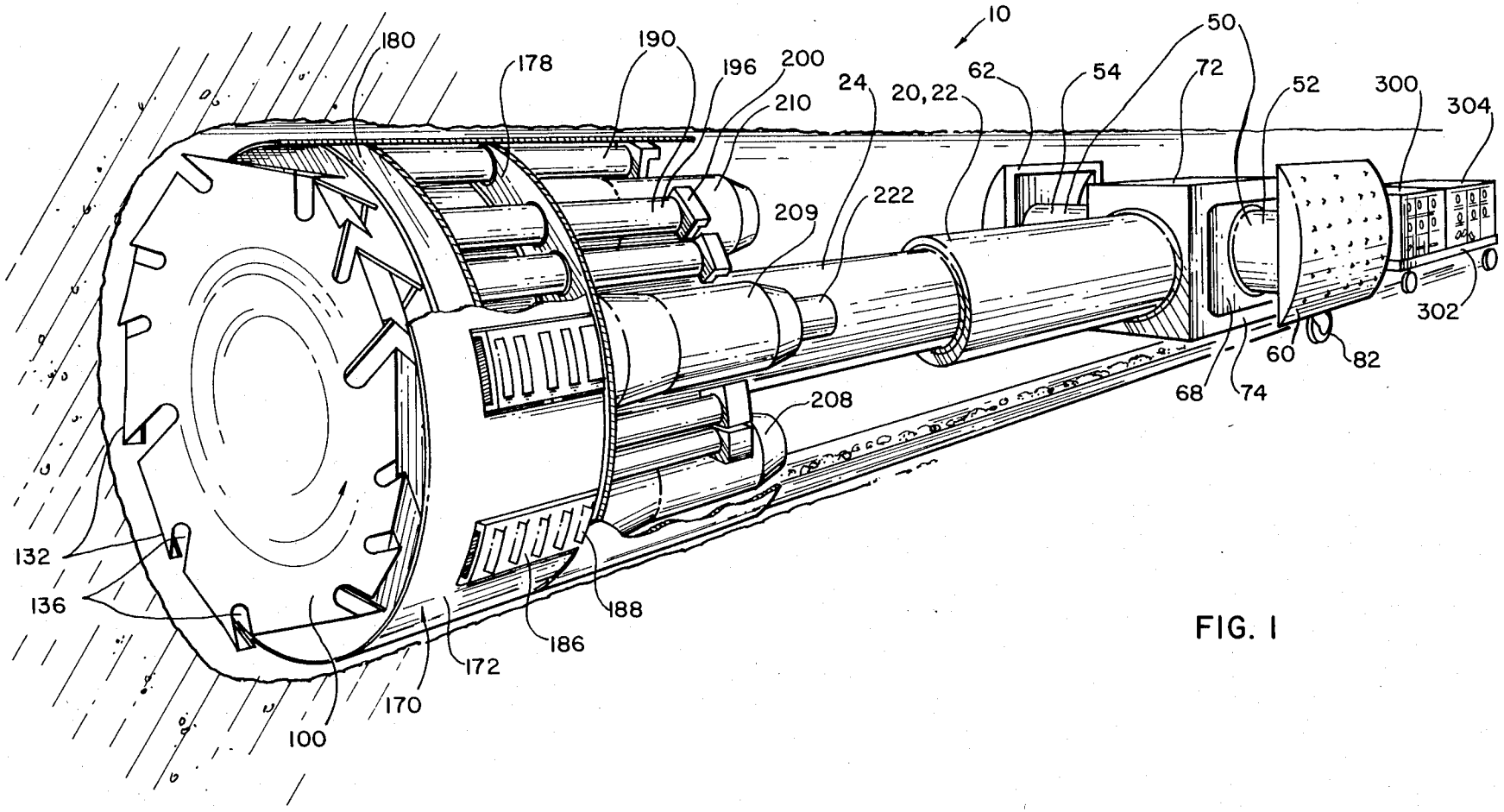
FIG. 1 is a perspective view of a tunnel boring machine.

As illustrated by the drawings the tunnel boring machine 10 of the present invention may be used to bore a tunnel having an end face 12 having a circular peripheral edge 13 and having a tunnel sidewall having lateral sidewall portions 14, 15, a roof sidewall portion 16, and a bottom sidewall portion 17. In an unstable ground mode of boring the tunnel boring machine 10 is used in combination with a conventional tunnel lining structure 18 constructed from wide flange beams 19 positioned in a spiraling configuration and wooden boards 21 positioned axially between spiral portions of the connected wide flange beams 19. The construction of a spiraling tunnel lining is used in combination with the present invention for the reason that the tunnel may be advanced incrementally by advancing a portion of the spiral which allows a substantial number of the axially extending shield jacks to be in constant contact with the tunnel lining structure 18 at all times to provide continuous thrusting as described in further detail below. The construction of a spiraling tunnel lining structure 18 has long been used and is well known in the mining arts.

Figure 8:
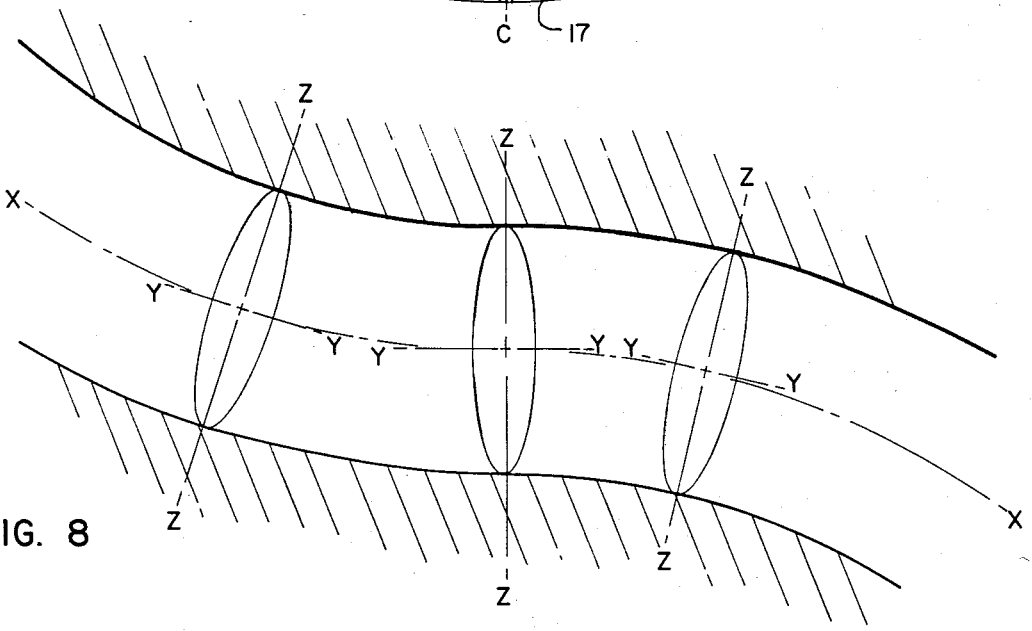
FIG. 8 is a transparent perspective view showing the various axes and surfaces of a tunnel.

For purposes of reference herein as illustrated by FIG. 8, the central axis of the tunnel is referred to as the tunnel longitudinal axis XX. The tunnel axis extending perpendicular to the tunnel longitudinal axis in a horizontal plane is referred to as a tunnel pitch axis YY. A tunnel axis intersecting the tunnel longitudinal axis XX and a pitch axis YY and perpendicular to both is referred to as a tunnel yaw axis ZZ. In horizontal boring both the longitudinal axis XX and the pitch axis YY lie in a horizontal plane and the yaw axis ZZ lies in a vertical plane. Of course each tunnel cross section has a separate set of pitch and yaw axes which may or may not be parallel to the pitch and yaw axes of other tunnel sections, depending upon the curvature of the tunnel. The longitudinal axis AA of the tunnel boring machine lies generally in a direction parallel to the tunnel longitudinal axis XX but may be slightly varied in alignment with respect to axis XX for the purpose of creating a curved tunnel.

Figure 2:
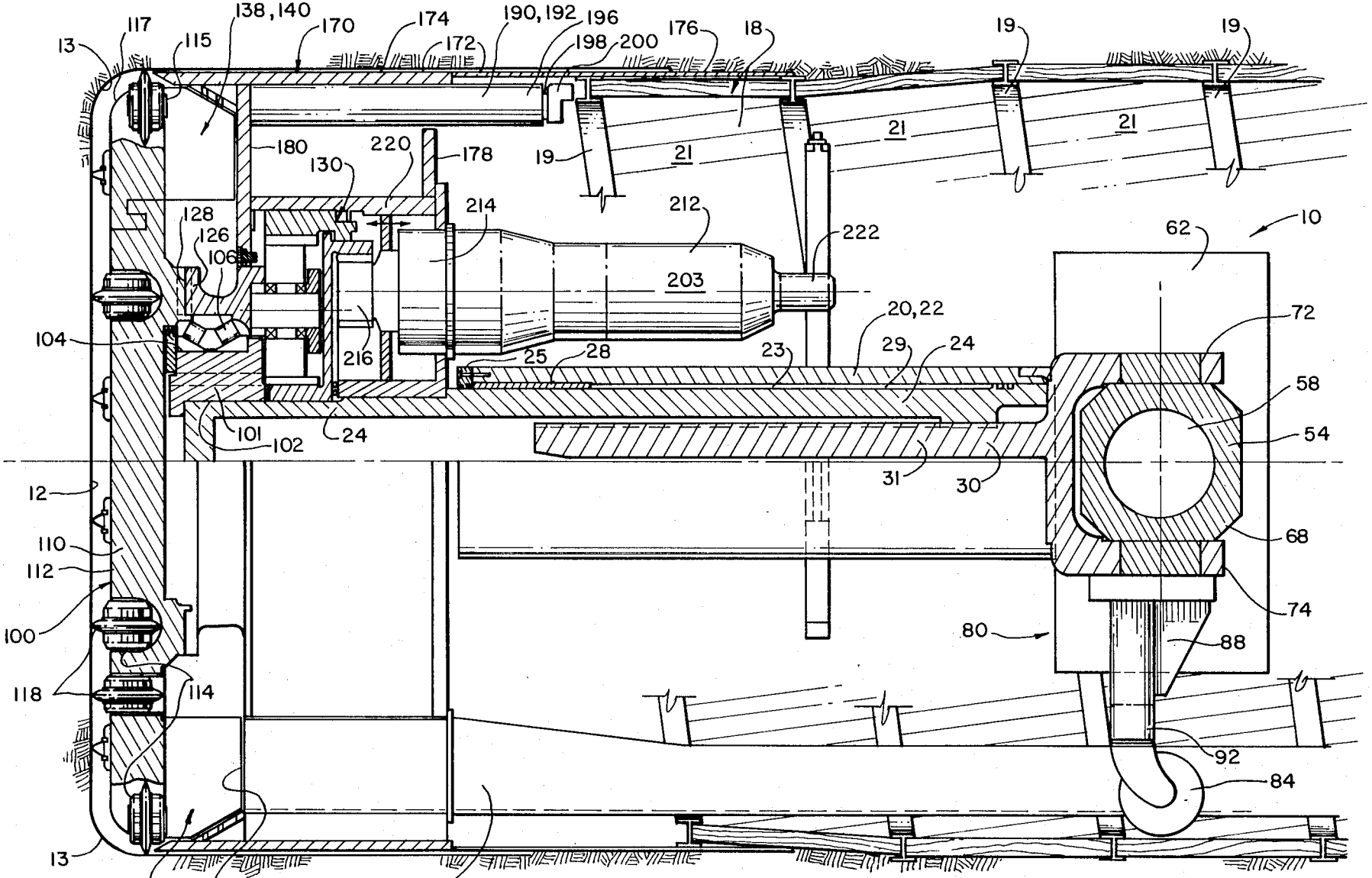
FIG. 2 is a partially cross-sectional side elevation view of the tunnel boring machine of FIG. 1.

As illustrated generally by FIGS. 1 and 2, the tunnel boring machine 10 of the present invention comprises a rotatable cutting wheel means 100 positioned at the front end of the machine having a central axis of rotation which is generally positioned in coaxial alignment with an associated portion of the tunnel central longitudinal axis XX. Cutting wheel means is selectively engageable with the tunnel end face 12 for cutting material away from the end face to elongate the tunnel in a forward direction. The cutting wheel means 100 comprises cutting devices 116 positioned thereon for spalling rock at the tunnel end face as the wheel is rotated. Rotation means such as motor means 203, 210 are operably associated with the cutting wheel means 104 selectively causing rotation thereof. In the preferred embodiment, the cutting wheel is rotatable at a relatively high speed during cutting in a stable ground mode of operation and is rotatable at a relatively lower speed in an unstable ground mode of operation. The machine comprises an extendable and retractable central thrust rod means 24 having a central thrust rod longitudinal axis positioned in substantially coaxial relationship with the rotatable cutting wheel means axis of rotation AA. Central thrust rod means transmits forward thrust to the cutting wheel means in both a central thrusting state of operation in stable ground conditions and a shield thrusting state of operation in unstable ground conditions. The central thrust rod means 24 also acts as a lever for transmitting prying torque to the cutting wheel means 100 when it becomes stuck or jammed against the tunnel sidewall or end face. The machine is provided with a central body means 20 for supporting the central thrust rod means in extendable and retractable relationship therein. In a preferred embodiment, the central body means 20 comprises a thrust cylinder barrel 22. The central body means is associated with a thrust generating means such as a conventional hydraulic system for thrust cylinder barrel 22. Extendable and retractable sidewall engaging means 50 are mounted on the central body means for selectively engaging opposite portions of the tunnel peripheral sidewall for preventing relative movement of the central body means 20 with respect to the tunnel sidewall while in a thrusting state of operation. The sidewall engaging means 50 may also be used for selectively radially shifting the central body means relative to the tunnel longitudinal axis XX for transmitting prying torque to the cutting wheel means 100 through the central thrust rod means 24. In a preferred embodiment, the extendable and retractable sidewall engaging means comprise laterally extending cylinder means 52, 54 pivotally mounted at a rearend portion of the machine for rotational movement about a rear machine yaw axis ZZ. Central body support means may be provided by a rear end positioning and support means 80 such as by tunnel floor engaging support wheel means 82, 84 which may extendably and retractably mounted on support wheel power cylinder means 86, 88. Annular shield means 170 are operably mounted on the central thrust rod means 24 for shielding a forward portion of the machine from collapsing tunnel sidewall material. Extendable and retractable shield thrust means 190 are operably associated with the shield means 170 for coacting with the tunnel lining structure 18 for selectively applying forward thrust to the cutting wheel means 100 through the central thrust rod means 24 during a a shield thrusting state of operation. Muck removal means which may comprise blades 132 and muck buckets 140, 150 and muck chute 144, or muck conveyor means 158 are provided to remove rock cuttings from the tunnel end face. Control means 300 for selectively operating various machine components are provided and may be carried behind the machine as on a utility trailer 302 which may also carry power generating means 304, spare parts, etc.

Central Body Means and Thrust Rod Member

Figure 3:
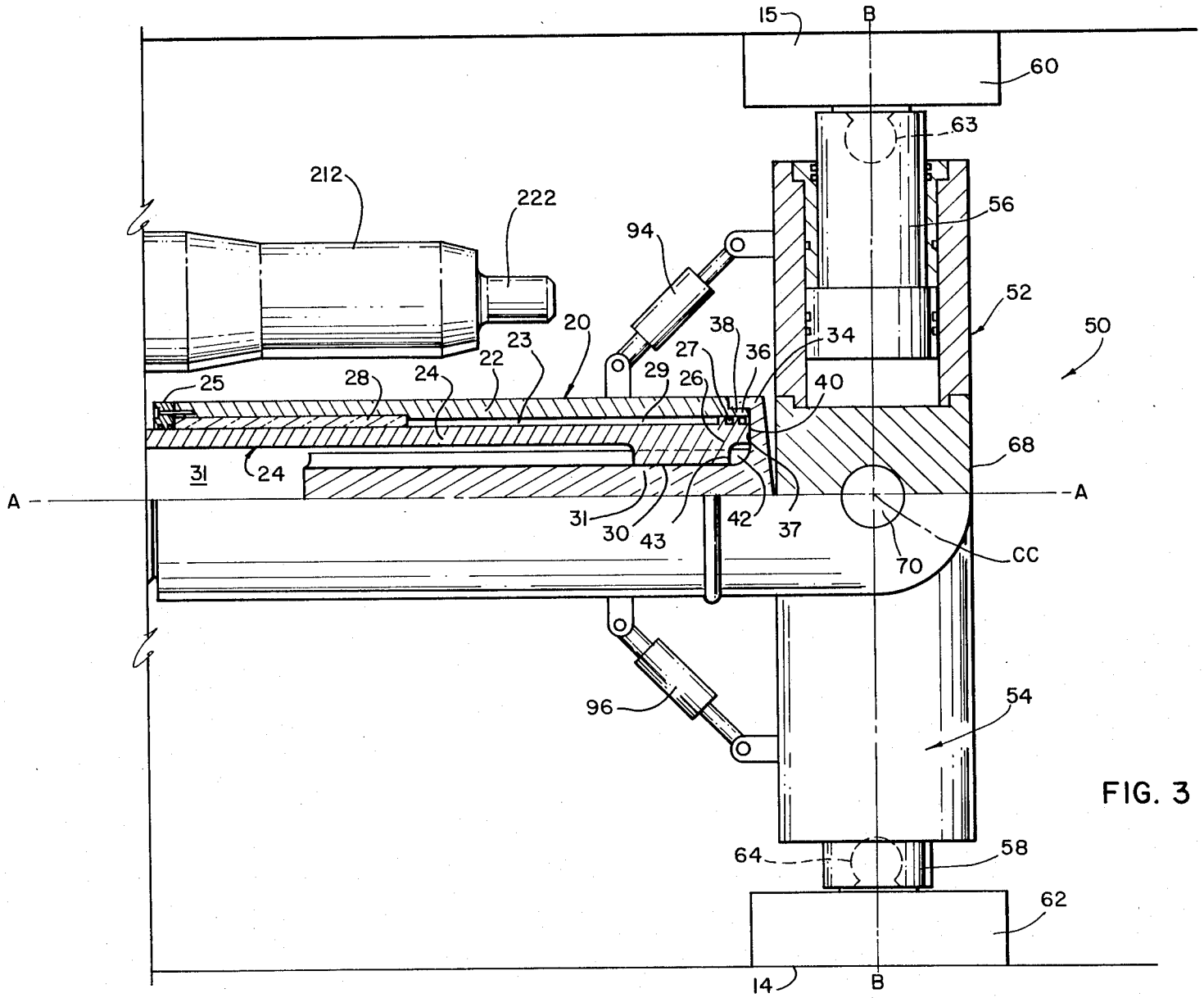
FIG. 3 is a partially cross-sectional top plan view of a rear portion of the tunnel boring machine of FIGS. 1–2.

As best illustrated by FIGS. 1, 2, and 3, the tunnel boring machine 10 of the present invention has an elongate central body means 20 for slidingly supporting a central thrust rod member 24. In the preferred embodiment the central body member 20 comprises a hydraulic thrust cylinder barrel member 22. However, the invention might also be practiced by a central body member which comprises a sleeve (not shown) with one or more externally mounted power cylinder units (not shown) affixed thereto and operably attached to a central thrust rod member 24. Other thrust transmitting means for transmitting thrust between the central body member 20 and central thrust rod member 24 such as screw jacks (not shown) etc., may also be used and are within the scope of the present invention.

In the preferred embodiment, the central body means 20 comprises an elongated cylindrically shaped cylinder barrel means 22 having a longitudinal axis which defines the machine longitudal axis AA. In a typical application, cylinder barrel means 22 may have a length on the order of 10 feet and a diameter on the order of 2 or 3 feet.

As illustrated by FIG. 3, the cylinder barrel means 22 has a cylindrical cavity 23 extending therethrough which allows the mounting of a cylindrical central thrust rod member 24 therein. The diameter of the thrust rod member 24 is slightly less than the diameter of the barrel cavity 23 except for the rear most portion thereof 26 which comprises annular seal means 27 which slidingly and sealingly engage the interior wall of the barrel means 22. The diameter differential between the thrust rod outer surface and the cylinder barrel inner surface creates an annular cavity 23 between the two surfaces. The forward portion of the annular cavity is filled by an elongated cylindrical bearing means 28 which maintains the opposed surfaces of the cylinder barrel means 22 and thrust rod member 24 in spaced apart sliding relationship. The bearing means 28 may be a bushing constructed from any number of conventional materials well known in the art and is maintained within the barrel means 22 by an end cap 25 conventionally attached to the forward end of the cylinder barrel means 22 in sealing relationship with the thrust rod 24 outer surface. The portion of the annular cavity positioned rearwardly of the bearing means 28 defines a variable volume fluid chamber 29 which extends rearwardly and terminates at the enlarged thrust rod end portion 26. Orifice means (not shown) positioned in communication with the fluid chamber 29 near the bearing means 28 are conventionally ported to allow inflow and discharge of pressurized hydraulic fluid to and from fluid chamber 29.

Central thrust rod member 24 may have an elongate bore 31 therein with a polygonal cross-section throughout at least a portion of its length. The bore 31 accepts a similar polygonal shaped torque shaft means 30 in close slideable relationship therein. The polygonal shape of the bore 31 and torque shaft means 30 prevents rotational motion of the torque shaft means 30 relative the thrust rod member 24. The torque shaft means has an enlarged end portion 34 which in turn comprises an annular bore 36 in the forward face 37 thereof for fixedly receiving the rear end portion 38 of the cylinder barrel 22 in sealed relationship therewith. The forward face 37 of the enlarged rear end portion 34 also provides a rear end wall 40 for terminating the rearward end of cavity 23. A variable volume fluid chamber 42 is defined by the space between the rear surface 43 of thrust rod member 24 and end wall 40. Conventional orifice means (not shown) allow inflow and discharge of pressurized hydraulic fluid from fluid chamber 42 for causing movement of the thrust rod member 24 within the cylinder barrel means 22. Thus, it may be seen that thrust rod member 24 is reciprocally mounted within cylinder barrel means 22. The thrust rod member 24 may be extended by inflow of hydraulic fluid into chamber 42 with simultaneous discharge of hydraulic fluid from chamber 29 and may be retracted by inflow of hydraulic fluid into chamber 29 and discharge from chamber 42 in a conventional manner well known in the art.

The torque shaft means 30 comprises upper and lower clevis plate portions at the enlarged rear end portion 34 thereof as discussed in further detail hereinafter.

Side Wall Engaging Means

Machine 10 is provided with extendable and retractable sidewall engaging means 50 for selectively laterally positioning the rear end portion of the machine 10 within the tunnel and to fixedly hold the rear end portion of the machine in gripping contact with the tunnel sidewall or tunnel lining. The sidewall engaging means 50 also, in combination with the central body support means discussed below, provide a prying means for prying the cutting wheel loose when it becomes wedged against the tunnel sidewall.

Figure 4:
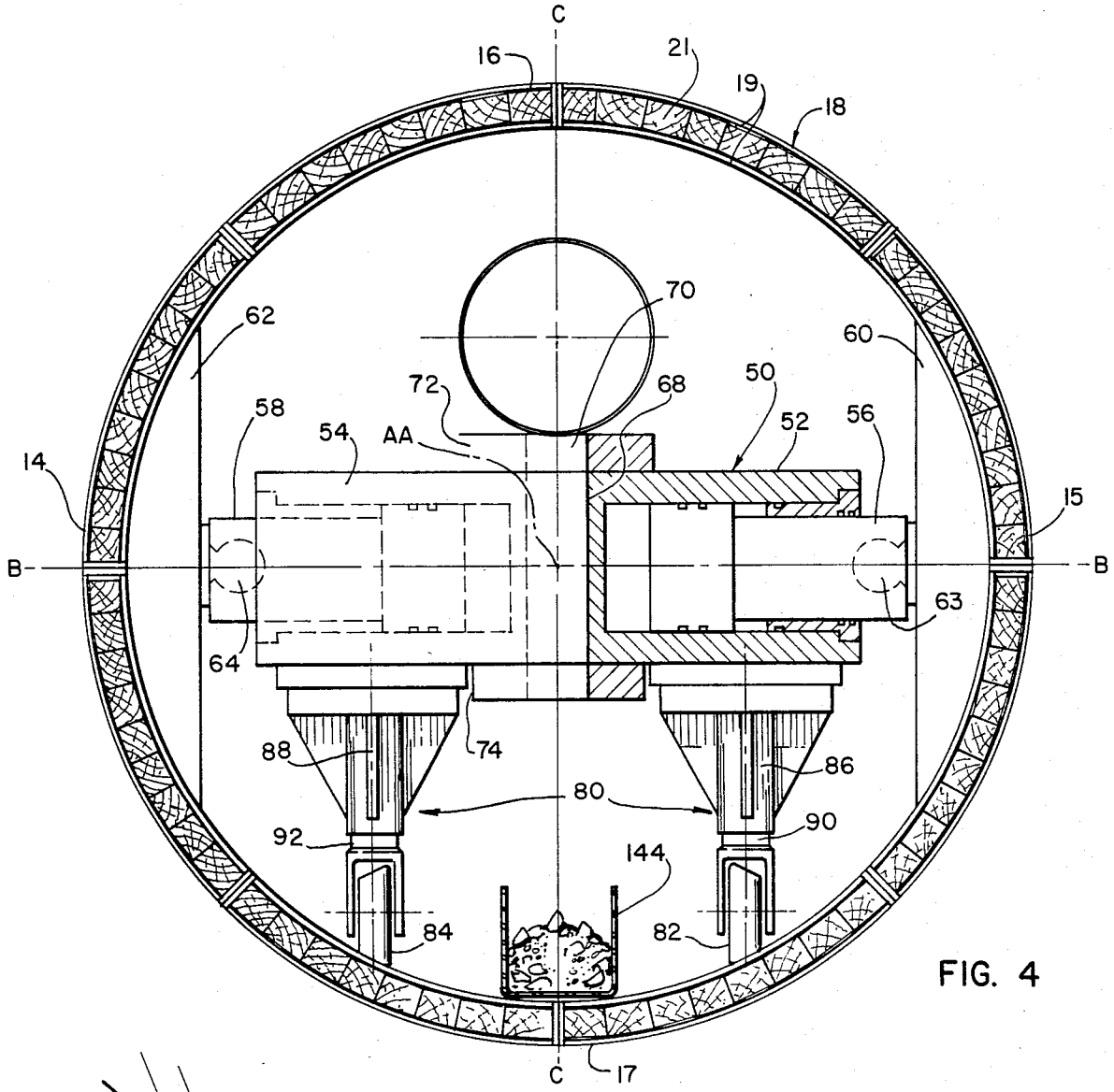
FIG. 4 is an end view from the rear of the tunnel boring machine of FIGS. 1–3.

As illustrated by FIGS. 1, 3 and 4, extendable and retractable sidewall engaging means 50 are provided by opposed, coaxial, fluid operable lateral power cylinder means 52, 54 positioned in coaxial alignment and generally positioned in coplanar relationship with tunnel longitudinal axes XX and YY and angularly displaceable with respect thereto. Each power cylinder means 52, 54 comprises a conventionally extendable and retractable lateral piston arm 56, 58 mounted therein and axially extendable along rear lateral cylinder axis BB. The terminal end of each piston rod 56, 58 is in turn swivelly attached to rear gripping shoe means 60, 62 as by ball joints 63, 64. Each piston arm 56, 58 is also rotatably mounted on suitable bearings within associated cylinder means 52, 54. Lateral cylinder means 52, 54 are fixedly attached at the inwardly positioned ends thereof to a pivot block means 68 pivotally mounted about rear machine yaw axis CC defined by rear pivot pin 70 which is in turn fixedly mounted between clevis portions 72, 74. The pivot block means 68 extends from clevis plate portion 72 to clevis plate portion 74 whereby it is pivotable only about machine yaw axis CC. Thus it may be seen that the central axis BB of cylinder means 52, 54 may be pivoted to various angular positions relative machine longitudinal AA and/or tunnel axis XX. The swivel mounting of the gripping shoe means 60, 62 relative to the lateral piston arms 56, 58 and the rotatable mounting of piston arms 56, 58 within cylinder means 52, 54 also allow the machine 10 to be rotatable about axis BB. Cylinder means 52, 54 and associated gripping shoe means 60, 62 may provide all the gripping force used to prevent rearward movement of the central body means 20 during a cutting stroke in both the stable ground cutting mode and the combined mode. The piston rods 56, 58 are selectively extendable whereby the position of rear machine yaw axis CC may be shifted laterally relative the tunnel center line XX as needed for centering operations prior to a new cutting stroke or for prying action to loosen the cutting wheel. Thus, it may be seen that the rear lateral cylinder means 52, 54 may be used to shift the rear end portion of the central body means 20 relative the tunnel sidewalls. The pivotal connection of the cylinder means 52, 54 with central body means 20, the rotational mounting of the piston arms 56, 58 within cylinders 52, 54 and the swivel attachment of the piston arms to the gripping shoe means allows the central body means to be universally pivotal within the tunnel.

Adjusting means such as hydraulic cylinder means 94, 96, FIGS. 1 and 3, mounted between lateral cylinder means 52, 54 and cylinder barrel 22 to align lateral cylinder axis BB in substantially perpendicular relationship with tunnel axis XX and/or machine axis AA at the beginning of each new cutting stroke in the stable ground and combined boring modes. The lateral cylinder means axis is positioned in perpendicular relationship with both the longitudinal tunnel axis XX and the longitudinal machine axis AA in straight line and vertically curved boring operations. In horizontally curved boring operations, however, axis BB is positioned perpendicular to tunnel axis XX but not to machine axis AA once horizontally curved tunnel cutting bias commences since machine axis AA is nonaligned with tunnel axis XX during horizontally curved boring.

A rear end positioning and support means 80, FIGS. 1, 2 and 4 is provided in parallel alignment with rear machine yaw axis CC as by tunnel floor engaging support wheel means 82, 84 extendably and retractably mounted on support wheel power cylinder means 86, 88 by support wheel piston rod means 90, 92. In the preferred embodiment, the support wheel power cylinder means 86, 88 are fixedly attached to the lower surface of lateral cylinders 52, 56 by conventional attachment means such as weldment or the like. Support wheel means 82, 84 may comprise a caster wheel assembly whereby the axis of rotation of each support wheel 82, 84 is freely rotatable about the longitudinal axis of each cylinder 86, 88. The support wheel means 82, 84 may be extended into engaging contact with the tunnel floor to provide rear support for the machine when sidewall engaging means 50 are disengaged from the tunnel sidewall. The support wheel means 82, 84 also facilitates forward movement of the rear portion of the machine during the retraction of central thrust rod member 24 in thrust cylinder means 20 between cutting strokes during stable ground and combined mode boring operations. The support wheels may also be aligned with their axes of rotation positioned in a longitudinal direction to facilitate relative angular movement about the machine axis AA in an adjustment mode to bring machine yaw axis CC into alignment with the surrounding gravitational field.

Cutting Wheel Means

Figure 6:
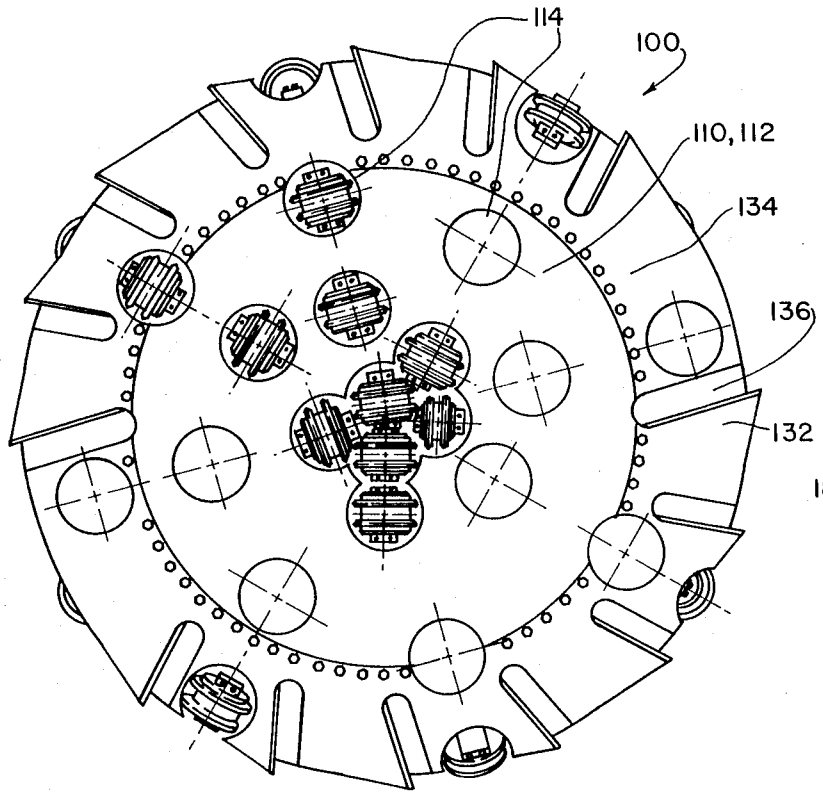
FIG. 6 is an end view from the front of the tunnel boring machine of FIGS. 1–5.
Figure 7:
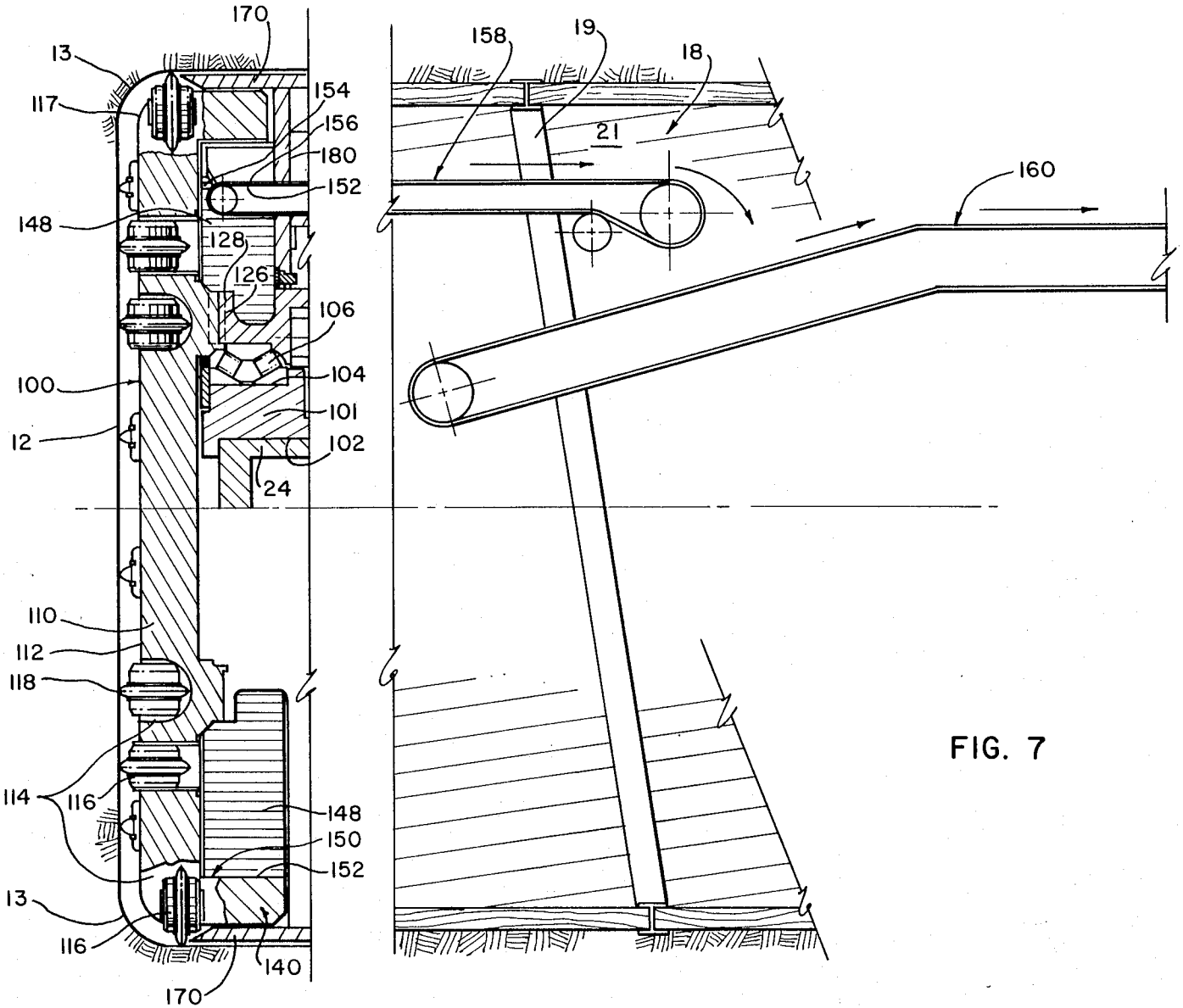
FIG. 7 is a partially cross-sectional detail side elevation view of a different embodiment of a tunnel boring machine.

As illustrated in FIGS. 2, 6 and 7 a cutting wheel means 100 having a central axis of rotation coaxial with central thrust member axis and machine axis AA is rotatably mounted on central thrust rod member 24 and is selectively engageable with the tunnel end face 12 for removing material therefrom. The cutting wheel means 100 is mounted on the central thrust rod member 24 as by fixed end cap means 101 having an interior cavity 102 adapted to receive an end portion of central thrust rod member 24. The end cap is held in non-rotatable relationship relative thrust member 24 as by locking key sections, weldement, or other fixed attachment means well known in the art. The exterior surface 104 of fixed end cap means 101 is rotatably mounted with cutting wheel hub means 126 by bearing means 106 such as conventional double row tapered roller bearings. Cutting wheel 100 comprises a radially extending cutting wheel plate 110 which, in the presently preferred embodiment, has a generally planar forward surface 112 having recessed portions 114 therein for receiving and rotatably supporting cutting devices 116 having cutting edges 118 which define the cutting surface of the machine. Cutting wheel plate 110 is relatively thick, on the order of 12" in a typical application, and supports gage cutting devices at the lateral peripheral surface 115 thereof and on a curved edge surface 117 integrally connected to the forward surface 112 and the lateral peripheral surface 115. The peripheral or "gage" cutting devices facilitate steering of the machine by cutting away a rounded edge portion 13 on the tunnel face 12. The cutting devices 116 are positioned at spaced apart intervals on the cutting wheel plate 110 and have cutting edges 118 which define the forward, lateral and edge cutting surfaces of the cutting wheel means 100. The cutting devices 116 engage the tunnel end face 12 and spall the surface to cause rock cuttings to be removed therefrom as is well known in the mining arts. The number of cutting devices may be increased for unstable ground cutting to help crush the rock to facilitate muck removal and to prevent jamming of the cutting wheel 100.

The cutting wheel plate 110 is fixedly connected at the rear surface 128 thereof to the cutting wheel hub means 126. The cutting wheel hub means is operably associated with rotational drive means such as through connection with conventional ring gear means 130, as discussed in further detail hereinafter.

Muck Removal Means

As illustrated by FIG. 6, the cutting wheel means 100 may be provided with blade means 132 at the outer edge of the forward surface thereof as by boltingly attached blade ring 134. The blade means 132 comprise part of a muck removal means for removing rock cuttings from the area between the tunnel end face 12 and the cutting wheel plate forward surface 112. Openings 136 between blade means 132 communicate with muck buckets 138 positioned behind the cutting wheel plate 110. In the embodiment illustrated in FIG. 2, the muck buckets 138 comprise an enclosing surface 140 having an axially directed opening 142 therein for transmitting rock cuttings in an axially rearward direction. This type of muck bucket is used in association with an machine 10 used to bore tunnels having an upwardly inclined longitudinal axis having an angle of inclination with the horizontal on the order of 30° or more. In this type of system the rock cuttings fall to the lower surface of the tunnel side wall and are swept through the blade means opening 136 and thence rearwardly through the muck bucket structure 140 into a muck chute 144 extending rearwardly down the tunnel. At angles of inclination on the order of 30° greater the force of gravity is sufficient to convey the rock cuttings down the muck chute. However, at angles of inclination of less than 30° conveyor means may be required for removal of rock cuttings from behind the cutting wheel means 100. As illustrated in FIG. 7 a muck ring 148 may be provided in radially inwardly disposed relationship with respect to muck buckets 150 having radially inwardly disposed openings 152. The muck ring 148 is mounted in non-rotational relationship with respect to the central thrust rod means 24 as by welded attachment to fixed end cap means 101. The muck ring 148 extends axially from the cutting wheel plate rear surface 128 to the forward surface radial shield support structure 180. Muck cuttings swept through blade openings 136 are thus moved around the muck ring in enclosed relationship within muck buckets 150 until reaching an upper portion 154 of the muck ring having a cut-out portion therein for accepting conveyor belt 156 of conveyor means 158. The rock cuttings are swept onto the conveyor belt 156 by the revolving movement of the muck buckets 150 and are carried by the conveyor belt 156 in a rearward direction for removal by the mine haulage system such as conveyor 160 at some position rearwardly removed from the machine 10.

The use of paddle and blade means and muck buckets for the removal of rock cuttings from a tunnel end face are well known in the art.

Annular Shield Means

It may be seen from FIGS. 1, 2, 5, and 7 that the machine 10 is provided with an annular shield means 170 for shielding a portion of the machine positioned forward of the tunnel lining structure 18. The annular shield means comprises a cylindrical shield plate 172 having an outer diameter slightly less than the diameter of the tunnel. The cylindrical shield plate 172 may comprise a forward portion 174 of high strength rigid material such as 2" steel plate and a rear portion fixedly attached to the forward portion formed from a more flexible material such as for example ¾" steel plate. The rear portion 172 of the cylindrical shield plate in one preferred embodiment extends rearwardly beyond the forwardmost edge of the tunnel lining structure 18 which is erected against the rear portion 176 inner surface. The shield plate forward portion 174 extends axially forward to a position immediately rearward of the rear most gage cutter device 116. The cylindrical shield plate 172 is attached and fixed in non-rotating relationship relative central thrust rod member 24 as by rigid attachment of radially extending plate member 178, 180 which are rigidly attached to fixed annular gear housing 220. The gear housing 220 is itself rigidly attached to thrust rod member 24 by conventional attachment means such as weldment or the like. Structural stiffening members 182, FIG. 5, may be provided to further strengthen the shield plate 172 against radially inwardly directed forces produced by collapsing tunnel walls and the like. Circumferentially spaced apart cut-out portions may be provided in the cylindrical shield plate 172 for providing extendable and tractable shield wall gripping means 184 therein. In a preferred embodiment the wall gripping means 184 comprise shield shoes 186 having a grooved outer surface 188 for grippingly contacting the tunnel sidewall surface. The shoes 186 also comprise laterally extending side 187 which slidingly engage radially extending support plates 189 rigidly affixed to the cylindrical shield plate 172 at the periphery of the openings therein. The wall gripping shoes 186 are reciprocal with respect to the surface of cylindrical shield plate 172 between a retracted position in substantially coincidental alignment with the arc of the shield plate surface and an extended position positioned several inches radially outward of the shield plate outer surface. In one preferred embodiment, two wall gripping means 184 are provided in opposed coaxial alignment at a position generally corresponding to the tunnel pitch axis with two lower wall gripping means positioned with axes in substantially coplanar relationship with the first two wall gripping means and equally circumferentially spaced beneath them, FIG. 5.

Axially aligned extendable and retractable shield thrust means 190 are operably associated with the shield means for coacting with the tunnel lining structure to selectively apply forward thrust to the shield means and thus the cutting wheel means during cutting in an unstable ground mode or in a combined mode of operation. In a preferred embodiment the shield thrust means comprise shield thrust jacks 192 fixedly mounted in a axially rearwardly extending direction at an inner surface of cylindrical shield plate 172 at the forward portion 174 thereof. The thrust jacks 192 may be mounted on mounting plates 194 and are further supported as by radially extending plates 178, 180. Each thrust jack 192 comprises a thrust jack cylinder 196 having a thrust jack piston 198 extendably and retractably mounted therein and having a thrust jack shoe 200 adapted for engaging the tunnel lining structure 18 mounted at the end thereof. The thrust jacks 192 are independently operable thus allowing a substantial portion of the total number of thrust jacks to remain in engaging contact with the tunnel lining structure while the remainder of the thrust jacks are retracted to allow spiral extension of the tunnel lining after which they are again reset and again begin thrusting while other jacks are retracted during cutting in the unstable ground mode or combined mode. In this manner during shield thrusting operations forward pressure is continuously applied against the cutting wheel obviating the need to stop the cutting operation when boring through unstable ground.

Machine steering may also be accomplished by selective extension of the shield thrusting means 190. For example, to urge the cutting wheel into an upwardly curved boring operation, thrust jacks at the lower periphery of the shield means 170 would be extended in a slightly greater distance than those at the upper periphery.

Drive Motor Means

Figure 5:
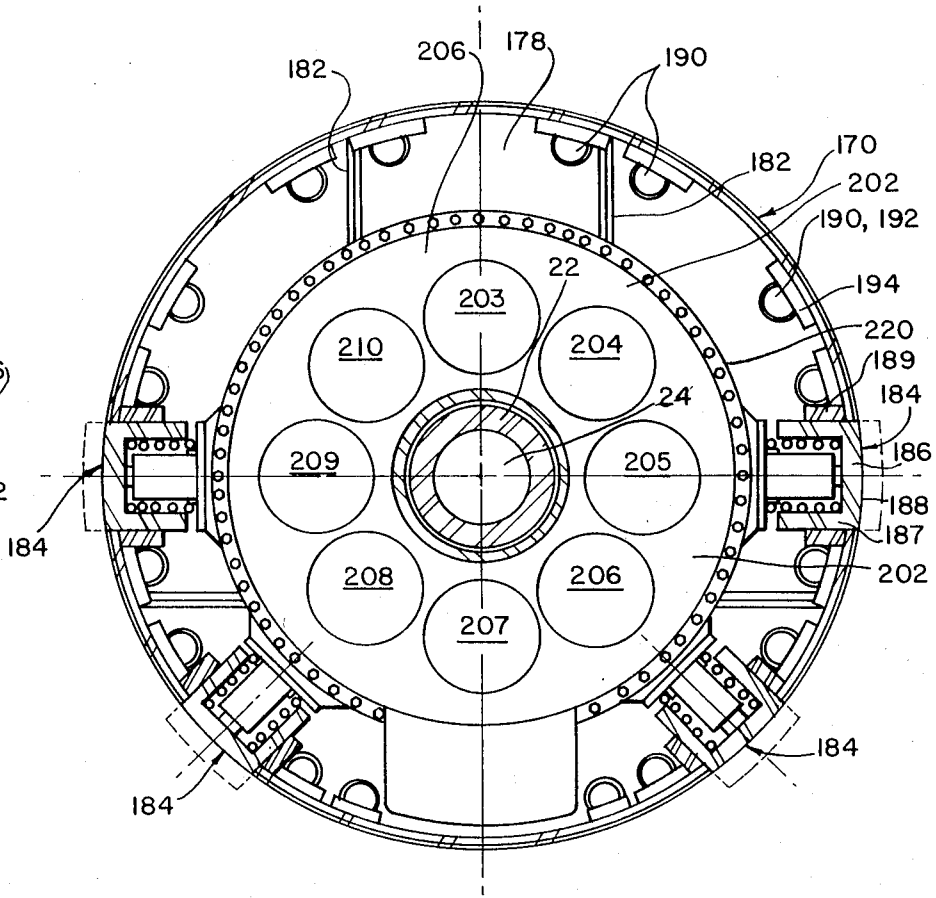
FIG. 5 is a cross-sectional end view from the rear of the tunnel boring machine of FIGS. 1–4.

Rotation means such as motor means 203–210, FIG. 5, are provided for rotating the cutting wheel means at preselected speeds. In a preferred embodiment, a radially extending motor support plate portion 202 of gear housing 220 supports motor means 203–210 in rotationally fixed relationship with respect to the thrust rod member 24. In the preferred embodiment, eight motor means, 203–210 are positioned in equally spaced circumferential relationship about the support plate 202 at a distance of approximately half the distance to the circumferential perimeter thereof. The drive motor means may comprise elongate axially extending housings 212 and axially extending drive shafts (not shown) which are connected with suitable reduction gear means 214 for transmitting rotational motion to pinion gear means 216 positioned within gear housing 220 on the forward side of annular support plate means 202. Pinion gear means 216 in turn engage drive ring gear means 130 which are operably associated with the cutting wheel by conventional planetary ring gear structure well known in the art. In the preferred embodiment, at least two separate gearing ratios, for stable ground boring and unstable ground boring, are provided by the gearing assembly. Thus, rotation of the pinion gear 216 by the drive motor means 203–210 causes relative rotational movement of the ring gear means 130 and thus cutting wheel means 100 relative to the motor means and thrust rod member 24.

A positioning motor 222, FIGS. 1 and 2, may be mounted on one or more of the motor means 203–210 at the rear end thereof in operable connection with the motor drive shaft for the purpose of slow controlled rotation of the motor drive shaft. The slow rotation of the drive shaft by the positioning motor 222 is used to adjust the angular position of the central body member 20 with respect to the cutting wheel means 100 for the purpose of placing the central body means in proper angular position about tunnel longitudinal axis XX. Another function of the positioning motor 222 is to controllably change the angular position of the cutting wheel to facilitate cutter device removal and replacement and other maintenance operations.

Control Means

Conventional hydraulic control means well known in the art may be provided to actuate the various hydraulic cylinder devices described herein to perform the various operations described herein. Similarly, conventional electrical motor controls and hydraulic motor controls may be conventionally provided to control the various drive motors and positioning motor described herein. The control assembly 300 may be provided as on a utility trailer 302 pulled at the rear of the machine 10. The utility trailer may also carry power generators 304, spare parts, etc.

Figure 9:
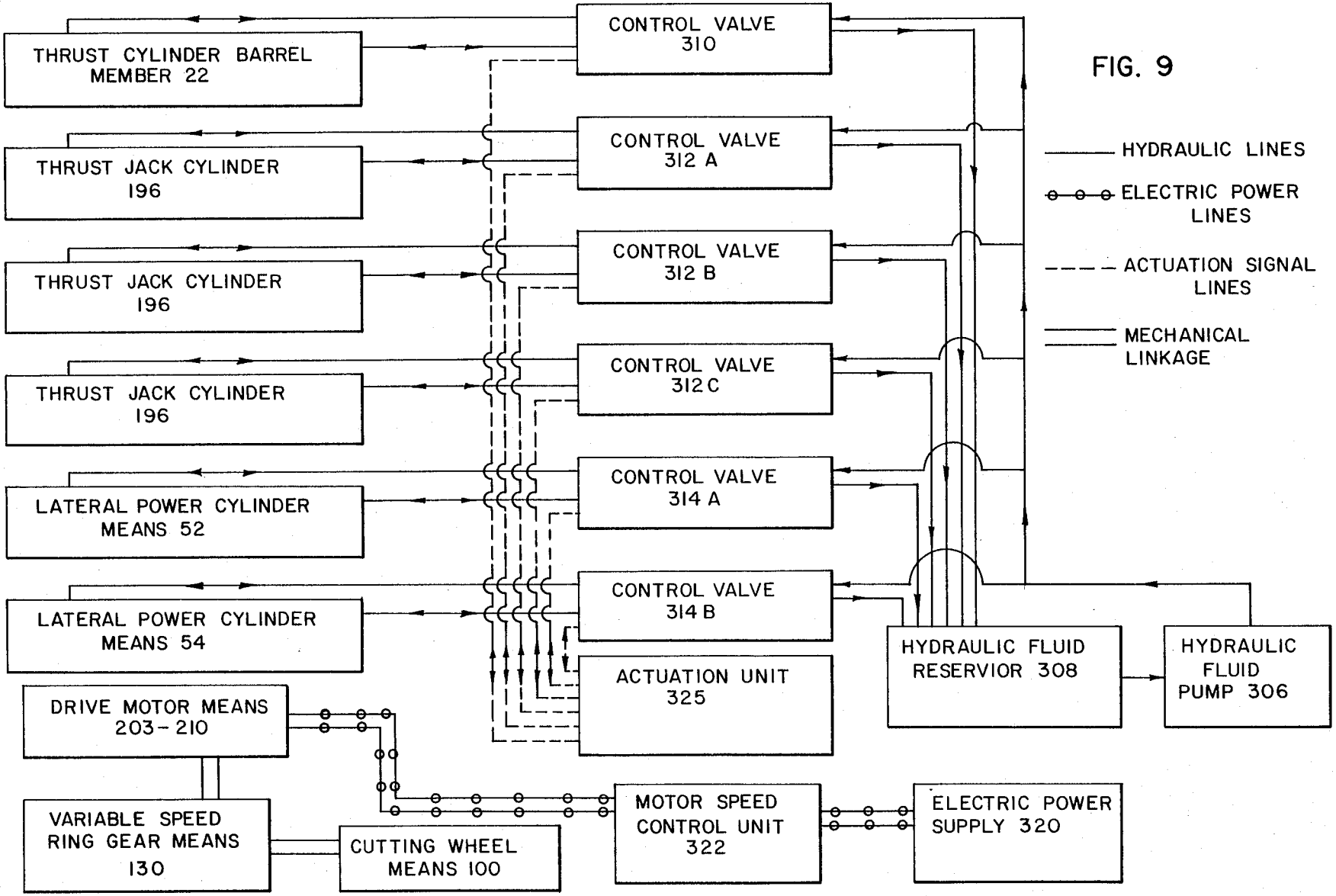
FIG. 9 is a schematic drawing showing a control system of the tunnel boring machine of FIGS. 1–7.

In particular, control means may comprise a control network as illustrated in FIG. 9 having:

central thrust generating means control means such as hydraulic control valve 310 for controlling the central thrust cylinder hydraulic system for extending the central thrust rod member from the central body means during a central cutting state of operation and for retracting the central thrust rod member relative the central body means for forward movement of said central body means during a central body resetting state of operation in both a stable ground mode of operation and a combined mode of operation and for maintaining the central thrust rod member in fixed relationship relative the central body means in an unstable ground mode of operation;

shield thrust means control means such as hydraulic control valves 312A–C, etc. for extending the shield thrust means for causing relative movement of the shield means with respect to the tunnel lining structure to advance the shield means during a shield cutting state of operation and for retracting the shield thrust means in a shield resetting state of operation in both an unstable ground mode of operation and a combined mode of operation;

sidewall engaging means control means such as hydraulic control valves 314A, 314B for extending the sidewall engaging means into gripping contact with an unlined tunnel sidewall surface prior to a central body cutting state of operation in a stable ground mode of operation, and for extending said sidewall engaging means into gripping contact with the tunnel lining structure prior to a central body cutting state of operation in a combined mode of operation, and for positioning the sidewall engaging means in noninterferring relationship with the unlined tunnel sidewall surface in a resetting state of operation in a stable ground mode of operation, and for positioning the sidewall engaging means in noninterferring relationship with the tunnel lining structure in a central body resetting state of operation in a combined mode of operation, and for positioning the sidewall engaging means in noninterferring relationship with the tunnel lining structure in a shield cutting or resetting state in an unstable ground mode of operation, and for selectively extending or retracting the sidewall engaging means with respect to the tunnel sidewall during a prying state of operation; and drive motor control means such as motor speed control unit 316 and/or variable speed ring gear means 130 for controlling the speed of rotation of the cutting wheel means.

Motive power for operating the various hydraulic cylinders may be furnished by a conventional hydraulic fluid pump 306 receiving hydraulic fluid from hydraulic fluid reservoir 308, the reservoir in turn receives surge flow ported thereto from the various control valves 310, 312A–C, 314A, B. Electrical energy is provided by an electric power supply 320 such as a generator unit or other conventional electric supply source. The control valves, motor speed control unit and/or variable speed ring gear means 130 may be actuated by conventional actuation unit 325 which may be operated mechanically, electrically or electronically by any number of conventional switching and control devices well known in the art. In one embodiment, the actuation unit 325 comprises a microprocessor for programmed operation of the machine in response to feed back from the various system components and operator input.

Typical Specifications

In a typical application the tunnel boring machine 10 of the present invention may have specifications tabulated below in Table II.

TABLE II

| | In Stable Rock | In Bad Ground |
|---|---|---|
| Excavation Diameter | 15 Feet | 15 Feet |
| Cutterwheel Stroke | 8 Feet | Continuous |
| Cutterwheel Speed | 10 RPM | 2.8 RPM |
| Total Installed Horsepower | (8 × 200)—1600 hp | (8 × 200)—1600 hp |
| Maximum Continuous Torque | 420,160 Ft-Lbs | 3,001,100 Ft-Lbs |
| Maximum Cutterwheel Thrust | 2,000,000 lbs | 3,000,000 lbs |
| Shield Thrust | N/A | 5,000,000 lbs |
| Muck Handling Capacity | Sufficient For 20 Ft/Hr | Sufficient For 6 Ft/Hr |
| Estimated Machine Weight | 260 tons | 260 tons |
| Estimated Trailing Equipment Weight | 80 tons | 80 tons |
| Machine Length | 22 feet | 22 feet |
| Trailer Length Approx. | 35–40 feet | 35–40 feet |
| No. of 16" Cutter Discs | 27 | 54 |
| Possible Ground Support Systems | Rock Bolts, Steel Ribs; Shotcrete, Wire Mesh & Bolts Injection Grouting | Steel Ribs and Lagging, Precast Concrete, Cast Iron Tubbing, Combination of Steel Ribs & Precast Concrete & Shotcrete, Grouting |

Operation

In boring a tunnel section through stable ground the tunnel boring machine is positioned adjacent the end face of a tunnel portion to be cut with the central thrust rod member 24 retracted within the central body means 20. The lateral cylinder means 254 positioned in perpendicular alignment with the tunnel side walls by alignment means 94, 96 and are then extended into gripping compressive engagement with the opposite tunnel sidewall portions 14, 15. The cutterwheel is rotated by the drive motor means 203–210 at a first predetermined rate suitable for cutting hard rock portions of the tunnel. The central thrust rod member 24 is then extended outwardly from the fixed central body means 20 and urges the cutting wheel into cutting engagement with the tunnel end face. The cutting wheel moves forward slidingly supported above the tunnel floor 17 by the annular shield means 170 during a cutting stroke. After the central thrust rod member has reached its full extension, rotation of the cutting wheel means 100 may be stopped. During the cutting stroke the support wheel means 82, 84 may be left in a lowered position in engagement with the tunnel floor 17 or may alternately be retracted after the lateral piston arms 56, 58 are extended. In the latter situation, the support wheel means 82, 84 must again be extended into floor engaging contact at the end of a cutting stroke. The lateral cylinder means, piston arms 56, 58 are thereafter retracted from gripping engagement with the tunnel wall and may be maintained in loose engagement therewith to maintain the central body means in centered position within the tunnel as it is moved forward. The central body means 20 is then moved forward through the tunnel by retraction of the central thrust member 24 therein while the cutter wheel maintains a fixed position relative the tunnel end face 12. The machine 10 is then in position to begin a new cutting stroke and the same procedures are again repeated as long as stable ground conditions are present. The lateral cylinder piston arms 63, 64 may be selectively extended or retracted as required to shift the rear end of the machine 10 in a prying motion to free the forward end of the machine in the event the cutter wheel or annular shield become stuck. Selective extension of the lateral cylinder means 52, 54 may also be used for the purpose of steering the machine for cutting curved tunnel portions, etc. Rear end support means 80 may similarly be extended and retracted for purposes of loosening the forward end of the machine from a stuck position or for steering a machine in a vertical direction.

Upon encountering unstable ground conditions, a determination must be made to operate the machine 10 in an unstable ground boring mode. At this time, a spiralling tunnel lining structure 18 is constructed as from wide flanged beams 19 and axially extending boards 21. In a preferred embodiment the spiral is extended to a point in overlapping engagement with the rear portion 176 of the machine annular shield means. The cutting wheel is then rotated at a second predetermined rate which is suitable for boring in unstable ground conditions. The unstable ground boring rate is considerably slower than the stable ground boring rate and prevents the cutting wheel from overexcavating sidewall or end face portions of the tunnel. The shield cylinder extendable and retractable thrust means 190 are then extended into engaging contact with associated adjacent portions of the tunnel lining with the exception of a few shield thrust means positioned adjacent the portion of the tunnel lining which is next to be advanced in the spiral construction. The cutting wheel means 100 is urged forward by extension of the shield thrust means 190 in a continuous forward motion. As the tunnel is advanced, the spiral tunnel lining 18 is also circumferentially advanced about the tunnel and associated adjacent shield thrust means are engaged with the advanced portion of the lining as other thrusting means 19 are disengaged therefrom to facilitate construction of a new portion of the lining in the adjacent area. In the unstable ground cutting mode the lateral cylinder means 52, 54 are used only to stabilize the rear end portion of the machine and are not used to anchor the rear end of the machine for forward thrusting. However, in a mixed mode of operation, the lateral cylinder means gripping shoe means are extended into compressive engagement with the inner side wall portions of the tunnel lining 18. Thrust may then be applied to the central thrust rod member 24 by the thrust means of the central body means 20 for providing additional forward thrusting force to that being applied by the shield thrusting means 190. Steering may be accomplished in both the unstable ground boring mode and the combined boring modes by selective extension of the shield thrust means on the side of the shield opposite the direction in which the machine is to be steered. This steering means may be used in combination with steering provided by the central body lateral sidewall engaging means 50 and rear support means 80. Shield shoe means 184 may be extended laterally to hold the cutting wheel means and shield means in a fixed position during stable ground boring between cutting strokes when the rear wall gripping means are retracted for forward movement of the central body means. The use of the shield shoe means 184 may not be required in horizontal tunnel boring but are definitely required in steeply inclined tunnel boring.

It is contemplated that the inventive concepts herein described may be variously otherwise embodied and it is intended that the appended claims be construed to include alternative embodiments of the invention except insofar as limited by the prior art.

What is claimed is:

1. A tunnel boring machine for boring a tunnel having tunnel lining structure areas in portions of the tunnel associated with unstable ground and having unlined areas in portions of the tunnel associated with stable ground, the tunnel having a central longitudinal axis, and having generally circular tunnel cross sections perpendicular to the central longitudinal axis, the tunnel cross section having a pitch axis oriented generally perpendicular to the direction of gravitational force and intersecting the central longitudinal axis and having a yaw axis intersecting the central longitudinal axis and the pitch axis and perpendicular to both, the tunnel having an end face and a peripheral sidewall with lined and unlined portions; the tunnel boring machine comprising:

rotatable cutting wheel means positioned at the front end of the machine having a central axis of rotation adapted to be selectively located at a position substantially coaxial with an associated portion of the tunnel central longitudinal axis the cutting wheel being selectively engageable with the tunnel face for cutting material away from the tunnel face to elongate the tunnel in a forward direction;

rotation means operably associated with said rotatable cutting wheel means for selectively causing rotation thereof in a cutting state of operation and for selectively stopping rotation thereof in a non-cutting state of operation;

extendable and retractable central thrust rod means having a central thrust rod longitudinal axis positioned in substantially coaxial relationship with said rotatable cutting wheel means axis of rotation for transmitting forward thrust to said cutting wheel means in a central thrusting state or a shield thrusting state of operation and for transmitting prying torque to said cutting wheel means in a prying state of operation;

central body means for supporting said central thrust rod means in extendable and retractable relationship therein;

central thrust generating means operably associated with said central body means for extending and retracting said central thrust rod means from said central body means;

extendable and retractable sidewall engaging means mounted on said central body means for selectively engaging opposite portions of the tunnel peripheral sidewall for preventing relative movement of said central body means with respect to the tunnel sidewall in a central thrusting state of operation and for selectively radially shifting said body means relative the tunnel longitudinal axis for transmitting prying torque to said cutting wheel means through said central thrust rod means in a prying state of operation;

central body support means for supporting said central body on the tunnel sidewall;

annular shield means operably mounted on said central thrust rod means for shielding a portion of the machine from collapsing tunnel sidewall material;

extendable and retractable shield thrust means operably associated with said shield means for coacting with the tunnel lining structure for selectively applying forward thrust to said cutting wheel means through said central thrust rod means during a shield thrusting state of operation;

muck removal means for removing material cut by said cutting wheel means at the tunnel face to a rearward position within the tunnel; and control means for selectively operating various machine components.

2. The invention of claim 1 wherein said control means comprise:

central thrust generating means control means for controlling said central thrust generating means for extending said central thrust rod means from said central body means during a central cutting state of operation and for retracting said central thrust generating means relative said central body means for forward movement of said central body means during a central body resetting state of operation in both a stable ground mode of operation and a combined mode of operation and for maintaining said central thrust rod means in fixed relationship relative said central body means in an unstable ground mode of operation;

shield thrust means control means for extending said shield thrust means for causing relative movement of said shield means with respect to the tunnel lining structure to advance the shield means during a shield cutting state of operation and for retracting the shield thrust means in a shield resetting state of operation in both an unstable ground mode of operation and a combined mode of operation;

sidewall engaging means control means for extending said sidewall engaging means into gripping contact with an unlined tunnel sidewall surface prior to a central body cutting state of operation in a stable ground mode of operation, and for extending said sidewall engaging means into gripping contact with the tunnel lining structure prior to a central body cutting state of operation in a combined mode of operation, and for positioning said sidewall engaging means in noninterferring relationship with the unlined tunnel sidewall surface in a resetting state of operation in a stable ground mode of operation, and for positioning said sidewall engaging means in noninterferring relationship with the tunnel lining structure in a central body resetting state of operation in a combined mode of operation, and for positioning said sidewall engaging means in noninterferring relationship with the tunnel lining structure in a shield cutting or resetting state in an unstable ground mode of operation, and for selectively extending or retracting said sidewall engaging means with respect to the tunnel sidewall during a prying state of operation.

3. The invention of claim 2 wherein said rotatable cutting wheel means is rotatably mounted on the forward end of said central thrust rod means.

4. The invention of claim 3 wherein said central body means comprises thrust cylinder barrel means for reciprocally accepting said central thrust rod means in coaxial alignment therein and wherein said central thrust generating means comprises hydraulic means operably associated with said thrust cylinder barrel means for linearly displacing said thrust rod means within said thrust cylinder barrel means.

5. The invention of claims 4 wherein said central thrust rod means is non-rotatably mounted within said central body means.

6. The invention of claims 5 wherein said extendable and retractable sidewall engaging means comprise lateral cylinder means for extending and retracting lateral pistons operably mounted therein.

7. The invention of claim 6 wherein said extendable and retractable sidewall engaging means further comprise shoe means pivotably mounted on said lateral pistons for engaging the tunnel sidewall.

8. The invention of claim 7 wherein said lateral cylinder means comprise two opposed coaxial lateral cylinders.

9. The invention of claim 8 wherein said opposed lateral cylinders are pivotally mounted at a rear portion of the central body means about a machine yaw pivot axis positionable in substantially parallel alignment with the yaw axis of an associated tunnel portion and wherein the central axis of said opposed lateral cylinders, the central thrust rod longitudinal axis, and the machine yaw pivot axis substantially intersect at a single point.

10. The invention of claim 9 wherein said shoe means are universally pivotably relative said lateral piston.

11. The invention of claim 10 further comprising lateral cylinder angular positioning means for selectively rotating said lateral cylinders about said machine yaw pivot axis.

12. The invention of claim 11 wherein said central body support means comprises extendable and retractable wheel means.

13. The invention of claim 12 wherein said extendable and retractable wheel means is extendable and retractable in a direction substantially parallel the machine yaw pivot axis.

14. The invention of claim 13 wherein said annular shield means comprises a generally cylindrical shield plate member having an outside diameter slightly less than the tunnel diameter, said plate member being fixedly non-rotatably attached to said central thrust rod means at a position immediately rearward of said cutting wheel means said cylindrical plate member having a central cylindrical axis positioned substantially coaxially with said central thrust rod means longitudinal axis.

15. The invention of claim 14 wherein said extendable and retractable shield thrust means comprise shield thrust cylinders fixedly mounted in circumferentially spaced apart relationship in the inner surface of said cylindrical shield plate member, said shield thrust cylinders being independently operable for selective forward thrust transmitting engagement with the tunnel lining structure and for disengagement therefrom during periods of tunnel lining extension whereby said shield thrust cylinders produce a continuous forward thrust on said cutting wheel through intermittent extension and retraction of different ones of said shield thrust cylinders.

16. The invention of claim 15 wherein said shield means further comprises shield radially extendable and retractable wall engaging means for engaging the tunnel sidewall for steering and to prevent the shield means from slipping backwards during inclined boring.

17. The invention of claim 16 wherein said shield radially extendable and retractable wall engaging means comprise shield radial cylinders.

18. The invention of claim 14 wherein said cutting wheel means comprises a forward circular cutting surface and a cylindrical lateral cutting surface and a curved edge cutting surface positioned therebetween.

19. The invention of claim 18 wherein said cutting wheel means comprises cutting rollers mounted on said cutting surface.

20. The invention of claim 19 wherein said cutting surfaces comprise cutting wheel plates and wherein said cutting rollers are mounted in recessed portions of said cutting wheel plates.

21. The invention of claim 20 wherein said shield means cylindrical plate member extends axially rearwardly from a forwardmost position immediately rearward of the rearward most cutting rollers.

22. The invention of claim 21 wherein said shield means cylindrical plate member extends rearwardly at least to the tunnel lining structure in an unstable ground mode of operation.

23. The invention of claim 22 wherein the tunnel boring machine further comprises steering means for steering the machine in a predetermined direction during cutting of the tunnel end face.

24. The invention of claim 23 wherein the steering means comprises said shield thrust means.

25. The invention of claim 24 wherein said steering means comprises said extendable and retractable sidewall engaging means and said central body support means.

26. The invention of claims 20 wherein said rotation means comprise circumferentially spaced apart motor means mounted n fixed annular relationship relative a forward portion of said central thrust rod means for driving engagement with ring gear means operably associated with cutting wheel means.

27. The invention of claim 26 wherein said rotation means comprises positioning motor means for slow rotation of said cutting wheel means for cutting wheel maintenance and for rotational alignment of said central body means relative the tunnel longitudinal axis.

28. The invention of claim 1 wherein said rotatable cutting wheel means is rotatably mounted on the forward end of said central thrust rod means.

29. The invention of claim 1 wherein said central body means comprises thrust cylinder barrel means for reciprocally accepting said central thrust rod means in coaxial alignment therein and wherein said central thrust generating means comprises hydraulic means operably associated with said thrust cylinder barrel means for linearly displacing said thrust rod means within said thrust cylinder barrel means.

30. The invention of claims 1 wherein said central thrust rod means is non-rotatably mounted within said central body means.

31. The invention of claims 1 wherein said extendable and retractably sidewall engaging means comprise lateral cylinder means for extending and retracting lateral pistons operably mounted therein.

32. The invention of claim 9 further comprising lateral cylinder angular positioning means for selectively rotating said lateral cylinders about said machine yaw pivot axis.

33. The invention of claim 1 wherein said central body support means comprises extendable and retractable wheel means.

34. The invention of claim 1 wherein said annular shield means comprises a generally cylindrical shield plate member having an outside diameter slightly less than the tunnel diameter, said plate member being fixedly non-rotatably attached to said central thrust rod means at a position immediately rearward of said cutting wheel means said cylindrical plate member having a central cylindrical axis positioned substantially coaxially with said central thrust rod means longitudinal axis.

35. The invention of claim 1 wherein said cutting wheel means comprises a forward circular cutting surface and a cylindrical lateral cutting surface and a curved edge cutting surface positioned therebetween.

36. The invention of claim 19 wherein said shield means cylindrical plate member extends axially rearwardly from a forwardmost position immediately rearward of the rearward most cutting rollers.

37. The invention of claim 1 wherein the tunnel boring machine further comprises steering means for steering the machine in a predetermined direction during cutting of the tunnel end face.

38. The invention of claim 23 wherein said steering means comprises said extendable and retractable sidewall engaging means and said central body support means.

39. The invention of claims 1 wherein said rotation means comprise circumferentially spaced apart motor means mounted in fixed annular relationship relative a forward portion of said central thrust rod means for driving engagement with ring gear means operably associated with cutting wheel means.

* * * * *